US010227979B2

(12) United States Patent
Zouani et al.

(10) Patent No.: US 10,227,979 B2
(45) Date of Patent: Mar. 12, 2019

(54) VANE SPACING FOR A VARIABLE DISPLACEMENT OIL PUMP

(71) Applicant: Ford Global Technologies, LLC, Dearborn, MI (US)

(72) Inventors: Abdelkrim Zouani, Canton, MI (US); Gabriela Dziubinschi, Dearborn, MI (US); Vidya Marri, Northville, MI (US); Simon Antonov, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 164 days.

(21) Appl. No.: 15/297,846

(22) Filed: Oct. 19, 2016

(65) Prior Publication Data

US 2018/0106252 A1 Apr. 19, 2018

(51) Int. Cl.

| | |
|---|---|
| ***F03C 2/00*** | (2006.01) |
| ***F04C 2/00*** | (2006.01) |
| ***F04C 14/18*** | (2006.01) |
| ***F04C 2/344*** | (2006.01) |
| ***F04C 15/00*** | (2006.01) |
| *F01C 21/08* | (2006.01) |
| *F04C 14/22* | (2006.01) |

(52) U.S. Cl.

CPC ..... *F04C 2/3442* (2013.01); *F04C 15/0049* (2013.01); *F01C 21/0836* (2013.01); *F01C 21/0863* (2013.01); *F04C 14/223* (2013.01); *F04C 14/226* (2013.01); *F04C 2210/206* (2013.01); *F04C 2250/20* (2013.01)

(58) Field of Classification Search

CPC ..... F01C 21/0836; F01C 21/0845; F01C 21/0863; F04C 2/3442; F04C 14/223; F04C 14/226

USPC ..... 418/24–27, 30, 150, 259, 266–268

See application file for complete search history.

(56) References Cited

U.S. PATENT DOCUMENTS

| | | | | |
|---|---|---|---|---|
| 2,278,131 | A | 3/1942 | Livermore | |
| 6,120,273 | A | 9/2000 | Mallen | |
| 6,666,671 | B1 | 12/2003 | Olver et al. | |
| 9,051,933 | B2 | 6/2015 | Kirchner et al. | |
| 2007/0128065 | A1* | 6/2007 | Agner, IV | F01C 21/0809 418/259 |

(Continued)

FOREIGN PATENT DOCUMENTS

WO 2017186272 A1 11/2017

*Primary Examiner* — Theresa Trieu

(74) *Attorney, Agent, or Firm* — Brooks Kushman P.C.; Julia Voutyras

(57) ABSTRACT

A vane fluid pump for a vehicle component has an inner rotor supported within a cam ring. A series of vanes is positioned within a series of slots in an inner rotor to define and separate a series of non-uniformly sized segmented pumping chambers to disrupt harmonics during operation to reduce pressure ripples and associated tonal noise. One chamber has a first sector angle being within a first predetermined range of a nominal value. A portion of the chambers each has a sector angle greater than the first sector angle, with an average sector angle greater than the nominal value by a second predetermined range. A remaining portion of the chambers each has a sector angle less than the first sector angle, with an average sector angle less than the nominal value by the second predetermined range.

17 Claims, 5 Drawing Sheets

(56) References Cited

U.S. PATENT DOCUMENTS

| | | | | |
|---|---|---|---|---|
| 2009/0074598 | A1* | 3/2009 | Tanasuca | F04C 14/226 418/26 |
| 2017/0089233 | A1* | 3/2017 | Moetakef | F04C 14/226 418/30 |
| 2017/0122315 | A1* | 5/2017 | Moetakef | F04C 14/226 418/30 |

* cited by examiner

VANE SPACING FOR A VARIABLE DISPLACEMENT OIL PUMP

TECHNICAL FIELD

Various embodiments relate to a vane oil pump for a powertrain component such as an internal combustion engine or a transmission in a vehicle.

BACKGROUND

An oil pump is used to circulate oil or lubricant through powertrain components such as an engine or a transmission in a vehicle. The oil pump is often provided as a vane pump. Vane pumps have a positive displacement characteristic and tight clearances between various components of the pump that result in the formation of pressure ripples or fluctuations of the fluid within the pump and the attached oil galleries during operation of the pump. The pressure ripples of the fluid generated by the pump may act as a source of excitation to powertrain components, for example, when the pump is mounted to the powertrain components. For example, the pump may be mounted to an engine block, a transmission housing, an oil pan or sump housing, a transmission bell housing, and the like, where the pressure ripples may cause tonal noise or whine from the engine or the transmission. This oil pump-induced powertrain whine or tonal noise is a common noise, vibration, and harshness (NVH) issue, and mitigation techniques may include countermeasures such as damping devices that are added to the powertrain to reduce noise induced by a conventional pump.

SUMMARY

In an embodiment, a vane fluid pump for a vehicle component has a cam ring defining a continuous inner wall surrounding a cavity, and an inner rotor supported within the cam ring. The inner rotor has an outer wall defining a series of slots spaced about the outer wall. The pump has a series of vanes, with each vane positioned within a respective slot of the inner rotor and extending radially outwardly to contact the continuous inner wall of the cam ring. The series of vanes define and separate a series of non-uniformly sized segmented pumping chambers configured to disrupt harmonics during operation to reduce pressure ripples and associated tonal noise. One chamber of the series of chambers has a first sector angle being within a first predetermined range of a nominal value. Each chamber in a first group of chambers of the series of chambers has a sector angle greater than the nominal value by a second predetermined range. Each chamber in a second remaining group of chambers of the series of chambers has a sector angle less than the nominal value by the second predetermined range.

In another embodiment, an inner rotor for a vane fluid pump has a body having a series of slots spaced about a perimeter of the body and extending radially outward, with adjacent slots in the series of slots in the body defining a series of sectors. A series of vanes is provided with each vane slidably received within a respective slot. One sector of the series of sectors has an angle within a first predetermined angular range. A first group of sectors in the series of sectors have corresponding angles within a second predetermined angular range. A second group of sectors in the series of sectors have corresponding angles within a third predetermined angular range. The first angular range is between and non-overlapping with the second and third angular ranges.

In yet another embodiment, a vane pump has an inner rotor eccentrically supported within a cam in a housing, with the rotor having an outer perimeter defining (n) axial slots separating (n) sectors. The pump has (n) vanes received by the (n) slots, respectively. One sector has an angle approximately at a nominal value, another (n−1)/2 sectors have corresponding angles greater than the nominal value, and the remaining (n−1)/2 sectors have corresponding angles less than the nominal value.

DETAILED DESCRIPTION

Figure 1:
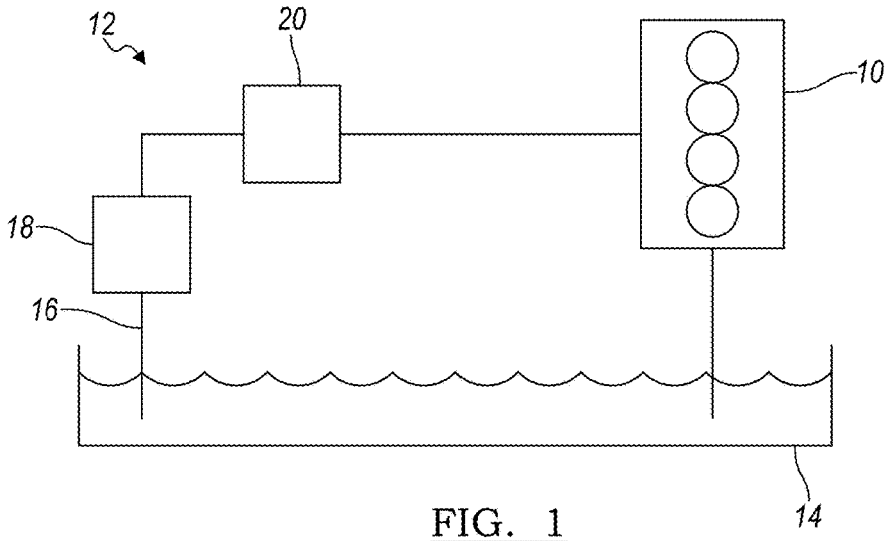
FIG. 1 illustrates a schematic of a lubrication system for an internal combustion engine in a vehicle according to an embodiment.

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

A vehicle component 10, such as an internal combustion engine or transmission in a vehicle, includes a lubrication system 12. The vehicle component 10 is described herein as an engine, although use of the system 12 with other vehicle components is contemplated. The lubrication system 12 provides a lubricant, commonly referred to as oil, to the engine during operation. The lubricant or oil may include petroleum-based and non-petroleum-synthesized chemical compounds, and may include various additives. The lubrication system 12 circulates oil and delivers the oil under pressure to the engine 10 to lubricate components in motion relative to one another, such as rotating bearings, moving pistons and engine camshaft. The lubrication system 12 may also provide the oil to the engine for use as a hydraulic fluid to actuate various tappets, valves, and the like.

The lubrication system 12 has a sump 14 for the lubricant. The sump 14 may be a wet sump as shown, or may be a dry sump. The sump 14 acts as a reservoir for the oil. In one example, the sump 14 is provided as an oil pan connected to the engine and positioned below the crankshaft.

The lubrication system 12 has an intake 16 providing oil to an inlet of a pump 18. The intake 16 may include a strainer or filter and is in fluid contact with oil in the sump 14.

The pump 18 receives oil from the intake 16 and pressurizes and drives the oil such that it circulates through the system 12. The pump 18 is described in greater detail below with reference to at least FIG. 2. In one example, the pump 18 is driven by a rotating component of the engine 10, such as a belt, a chain or a mechanical gear train driven by the crankshaft. In other examples, the pump 18 may be driven by another device, such as an electric motor.

The oil travels from the pump 18, through an oil filter 20, and to the vehicle component or engine 10. The oil travels through various passages within the engine 10 and then leaves or drains out of the engine 10 and into the sump 14.

The lubrication system 12 may also include an oil cooler or heat exchanger to reduce the temperature of the oil or lubricant in the system 12 via heat transfer to a cooling medium such as environmental air. The lubrication system 12 may also include additional components that are not shown including regulators, valves, pressure relief valves, bypasses, pressure and temperature sensors, additional heat exchangers, and the like.

The pump 18 has a positive displacement along with tight clearances between various components that may result in the formation of excessive pressure ripples within the pump and the attached oil galleries. The pressure ripples of the pump when mounted on a vehicle component such as an engine block or a transmission housing may act as a hydraulic excitation source to the various components, such as an oil pan, transmission bell housing, etc.

Figure 2:
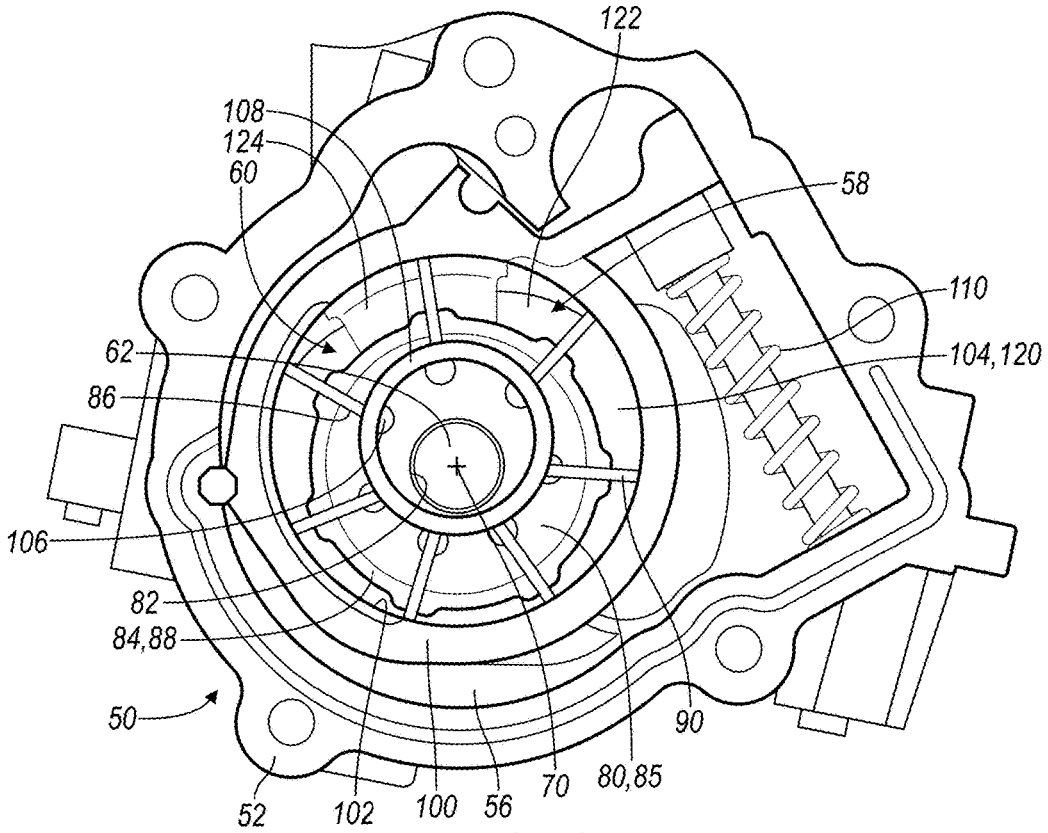
FIG. 2 illustrates a partial perspective view of a vane pump according to an embodiment.

FIG. 2 illustrates a pump 50 and various components thereof according to an embodiment. The pump 50 may be used in the lubrication system 12 as pump 18.

Referring to FIG. 2, the pump 50 is a vane pump, and is illustrated as being a sliding vane pump. In other examples according to the present disclosure, the vane pump 50 may be other types of vane pumps including pendulum vane pumps, swinging vane pumps, and the like.

The pump 50 has a housing 52 and a cover (not shown). The housing 52 and the cover cooperate to form an internal chamber 56. The cover connects to the housing 52 to enclose the chamber 56. The cover may attach to the housing 52 using one or more fasteners, such as bolts, or the like. A seal, such as an O-ring or a gasket, may be provided to seal the chamber 56.

The pump 50 has a fluid inlet 58 and a fluid outlet 60. The fluid inlet 58 has an inlet port that is adapted to connect to a conduit such as intake 16 in fluid communication with a supply, such as an oil sump 14. The fluid inlet 58 is fluidly connected with the chamber 56 such that fluid within the inlet 58 flows into the chamber 56. The cover and/or the housing 52 may define portions of the inlet 58 region and inlet port. The inlet 58 may be shaped to control various fluid flow characteristics.

The pump 50 has a fluid outlet 60 or fluid discharge that has an outlet port that is adapted to connect to a conduit in fluid communication with an oil filter, a vehicle component such as an engine, etc. The fluid outlet 60 is fluidly connected with the chamber 56 such that fluid within the chamber 56 flows into the outlet 60. The cover and/or the housing 52 may define portions of the outlet 60 region and outlet port. The outlet 60 may be shaped to control various fluid flow characteristics. The inlet 58 and the outlet 60 are spaced apart from one another in the chamber 56, and in one example, may be generally opposed to one another.

The pump 50 has a pump shaft or driveshaft 62. The pump shaft 62 is driven to rotate components of the pump 50 and drive the fluid. In one example, the pump shaft 62 is driven by a mechanical coupling with an engine, such that the pump shaft rotates as an engine component such as a crankshaft rotates, and a gear ratio may be provided to provide a pump speed within a predetermined range. In one example, an end of the pump shaft 62 is splined or otherwise formed to mechanically connect with a rotating vehicle component to drive the pump 50.

The other end of the shaft 62 is supported for rotation within the cover and housing 52 of the pump 50. The cover and housing may define supports for the end of the shaft to rotate therein. The support may include a bushing, a bearing connection, or the like. The shaft 62 rotates about a longitudinal axis 70 of the shaft.

The shaft 62 extends through the housing 52, and the housing 52 defines an opening for the shaft to pass through. The opening may include a sleeve or a seal to retain fluid within the pump and prevent or reduce leakage from the chamber 56. The opening may also include additional bushings or bearing assemblies supporting the shaft for rotation therein.

An inner rotor 80 or inner gear is connected to the pump shaft 62 for rotation therewith. The inner rotor 80 has an inner surface or wall 82 and an outer surface or wall 84. The inner wall 82 is formed to couple to the pump shaft for rotation therewith about the axis 70. In one example, the inner wall 82 is splined to mate with a corresponding splined section of the pump shaft, and in another example, is press fit onto the shaft 62.

The outer wall 84 provides an outer circumference or perimeter of the inner rotor 80. In one example, the outer wall is cylindrical or generally cylindrical. In other examples, the outer wall 84 is provided by another shape, such as a polygon, or the like. The outer wall 84 extends between opposed end faces 85 of the inner rotor 80.

The inner rotor 80 has a series of slots 86 and a series of outer wall sections 88, or side wall sections. In the example shown in FIG. 2, the inner rotor has seven slots and seven outer wall sections. The rotor 80 may have nine slots and nine wall sections as shown and described with respect to FIGS. 6-7, eleven slots and eleven wall sections as shown and described with respect to FIGS. 8-9, or another number of slots and corresponding outer wall sections in other examples.

The slots 86 are spaced apart about the outer wall 84, and are unequally spaced, variably spaced, or spaced at predetermined angles about a longitudinal or axial axis of the inner rotor. The slots 86 define or provide the outer wall sections 88, as they divide the outer wall 84. Each outer wall section 88 is bounded by adjacent slots 86. The slots and outer wall sections alternate about the perimeter of the inner rotor 80. The outer walls sections 88 may lie about a perimeter of a common cylinder or common polygon such that each outer wall section has a surface formed by a segment or sector of a cylinder. The sectors are described in further detail below with reference to FIG. 5. The size of each outer wall section 88 may vary in comparison to the other wall sections based on the spacing of the slots 86.

A series of vanes 90 is provided, with each vane positioned within a respective slot 86. Each slot 86 is sized to receive a respective vane 90. The vanes 90 are configured to slide within the slots 86. The vanes 90 and slots 86 may extend radially from the inner rotor 80 and axis 70, or may extend non-radially outwardly from the inner rotor 80.

Each outer wall section 88 extends between adjacent vanes 90. The inner rotor 80 rotates as the pump shaft 62 rotates. In the example shown, the inner rotor 80 rotates in a rotational direction, e.g. a counter-clockwise direction as shown in FIG. 2, about axis 70.

The pump 50 has a cam ring 100 that has a continuous inner wall 102, the cam ring 100 may also be referred to herein as a cam 100. The cam ring 100 is supported within the internal chamber 56 of the housing 52. The inner wall 102 of the cam ring 100 may be a cylindrical shape as shown. The inner wall 102 defines a cavity 104. The inner rotor 80 and the vanes 90 are arranged and supported within the cavity 104 of the cam ring 100.

The inner rotor 80 may be eccentrically supported within the cam ring 100 such that the axis 70 of the inner rotor is offset from an axis or the center of the cylindrical inner wall 102 and the cam ring 100.

In one example, as shown, the pump 50 is a variable displacement pump and may include a control mechanism 110 such as a spring or passively or actively controlled pressure compensator that changes the position of the cam ring 100 in the housing, thereby changing the eccentricity between the cam ring 100 and the inner rotor 80 to change the size of the pumping chambers and vary the displacement per revolution of the pump. Alternatively, the cam ring 100 may have various protrusions or locating features that cooperate with the housing 52 to position and fix a location of the cam ring 100 in the pump 50.

The vanes 90 extend outwardly from the inner rotor 80, and a distal end of each vane 90 is adjacent to and in contact with the inner wall 102 of the cam ring during pump operation. The inner rotor, the cam ring, and the vanes cooperate to form a plurality of variable volume pumping chambers to pump fluid from a fluid inlet 56 of the pump to a fluid outlet 60 of the pump. The vanes act to divide the chamber 56 into pumping chambers 120, with each vane positioned between adjacent pumping chambers 120. As the inner rotor 80 rotates, the spacing between the outer wall 84 of the inner rotor and the cam ring inner wall 102 changes at various angular positions about the cam ring 100. The chamber 122 formed by the inner rotor, vanes, and cam ring near the inlet port 58 increases in volume, which draws fluid into the chamber from the inlet port. The chamber 124 near the outlet port 60 is decreasing in volume, which forces fluid from the chamber into the discharge port and out of the pump.

The vanes 90 may slide outwardly during pump operation based on centrifugal forces to contact the inner wall of the cam ring and seal the variable volume chambers. In other examples, a mechanism such as a spring, or a hydraulic fluid, may bias the vanes 90 outwardly to contact the cam ring inner wall.

The inner rotor 80 may include under-vane passages 106 that act as back pressure chambers for pressure relief as the vane 90 retracts. The inner rotor 80 may also include a vane ring 108 supported on one of the end faces 85 of the inner rotor 80 that prevents retraction of the vanes when the pump 50 is stopped and centrifugal forces on the vanes are absent. The proximal end of the vanes 90 abuts the vane ring 108.

FIGS. 5-9 describe various examples of inner rotors having different numbers of vanes for use in a vane pump such as pump 50. Various embodiments relate to methods and systems for delivering appropriate oil pressure using a variable displacement vane pump, and specifically the vane spacing arrangements, wherein noise generated by the oil pump is reduced.

Figure 3:
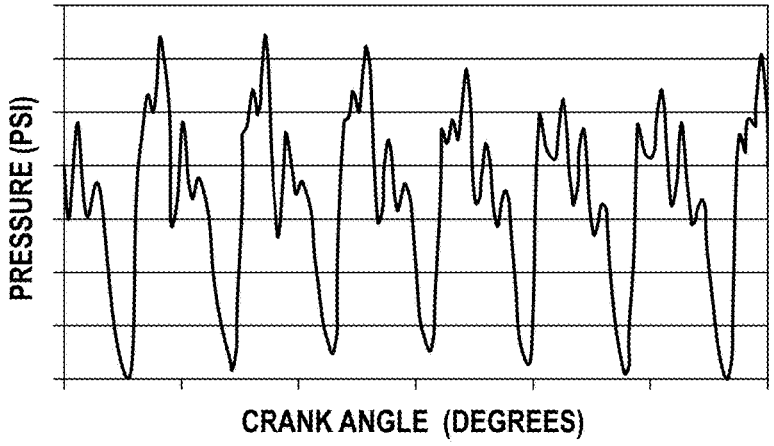
FIG. 3 illustrates an example of pressure output with revolutions of a convention vane oil pump with equally spaced vanes.

In a conventional variable displacement vane oil pump, as the pump operates, oil pressure ripples are created as described above from the underlining excitation energy within the lubrication system. The excitation energy may results in objectionable levels of whine noise under light vehicle acceleration or during deceleration. In a conventional variable displacement oil pump with (n) equally spaced vanes in the pump, the harmonics of the pressure ripples generated by the vanes are additive and may create high levels of 3n, 4n, 5n, 6n, etc. order pressure (as multiples of (n) number of vanes). FIG. 3 illustrates pressure at the pump outlet versus pump rotation for a conventional vane pump with equally spaced vanes. In the present disclosure, a predetermined uneven spacing of the vanes is used to minimize the magnitude of the most objectionable harmonics (e.g., in order of importance: 3n, 4n, 5n, and 6n) by spreading the excitation energy over a wider frequency band while maintaining other operational characteristics for the pump.

Figure 4:
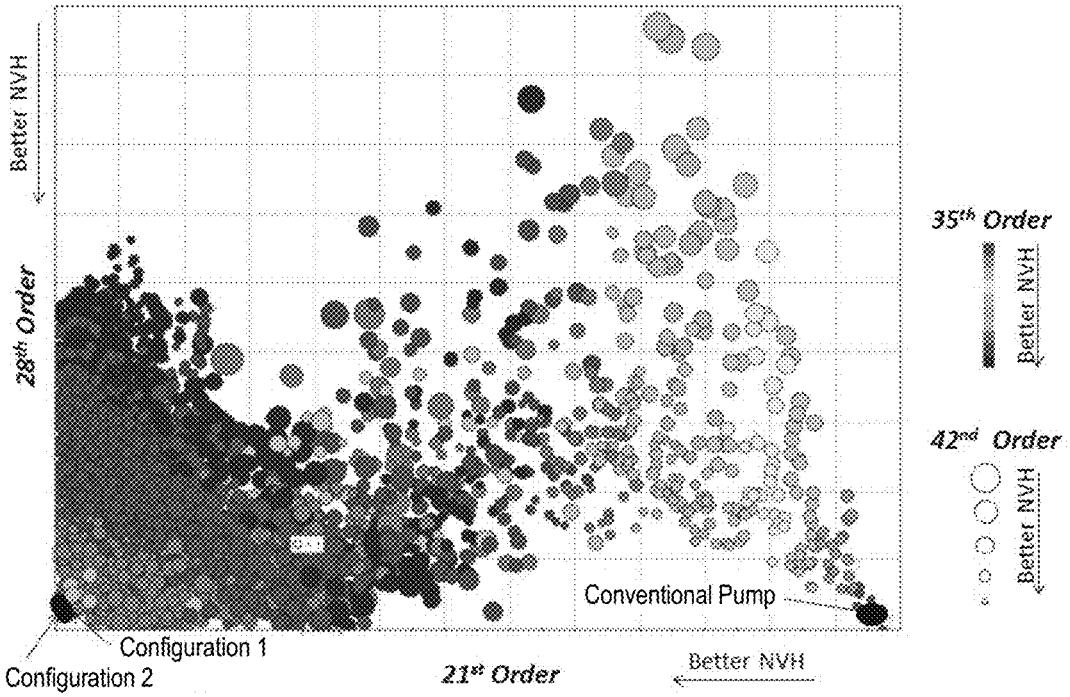
FIG. 4 illustrates an example of modeling results for spacing of a vane oil pump according to the present disclosure.

An analytical method was used to determine the optimal value of each of the (n) sectors of the vane pump to minimize the critical orders of the pump outlet pressure. The method used the assumption that each sector of the rotor creates a triangular pressure pulse at the outlet of the pump. The width of the pressure pulse is equal to the value of the angle of the associated sector. The pressure trace created after a full revolution of the pump is computed as the summation of the individual pulses created by each of the (n) sectors. The method used a routine to compute the total pressure trace and the corresponding critical orders (multiples of (n)) for any given values of the angles of the (n) sectors. The method employed commercial software in combination with the routine to vary the angles of the (n) sectors in order to create the design space and perform an optimization using a genetic algorithm. The method further constrained the analysis with the allowable minimum and maximum sector angles. The maximum width of the larger sectors is limited by the pump performance, e.g. risk for not filling the vane properly or leakage between inlet and outlet port, and by the durability risk due to the buildup of excessive peak pressure at the pump outlet. The minimum width of the smaller sector is limited by oil pump rotor durability. In addition the method was constrained as the total sum of the angles of all (n) sectors is set to equal to 360 degrees. Typical result of this analysis is shown in FIG. 4 for a seven vane oil pump. In this case, configurations 1 and 2 are selected as examples of vane pumps having low levels of the $21^{st}$ and $28^{th}$ orders. Similar studies were done for the nine and eleven vane examples as described herein. Of course, the study may be expanded for use with inner rotors and pumps having another number of vanes, another profile of the pressure trace and/or to tune the pump noise to reduce noise levels at other harmonics or based on pump operating conditions or the surrounding environment. The modeling was used to create and define parameters for vane spacing and positioning about the inner rotor. Parameters are provided for a general inner rotor of a vane pump having (n) vanes, as well as for specific examples of a seven vane pump, nine vane pump, and eleven vane pump as described below.

Figure 5:
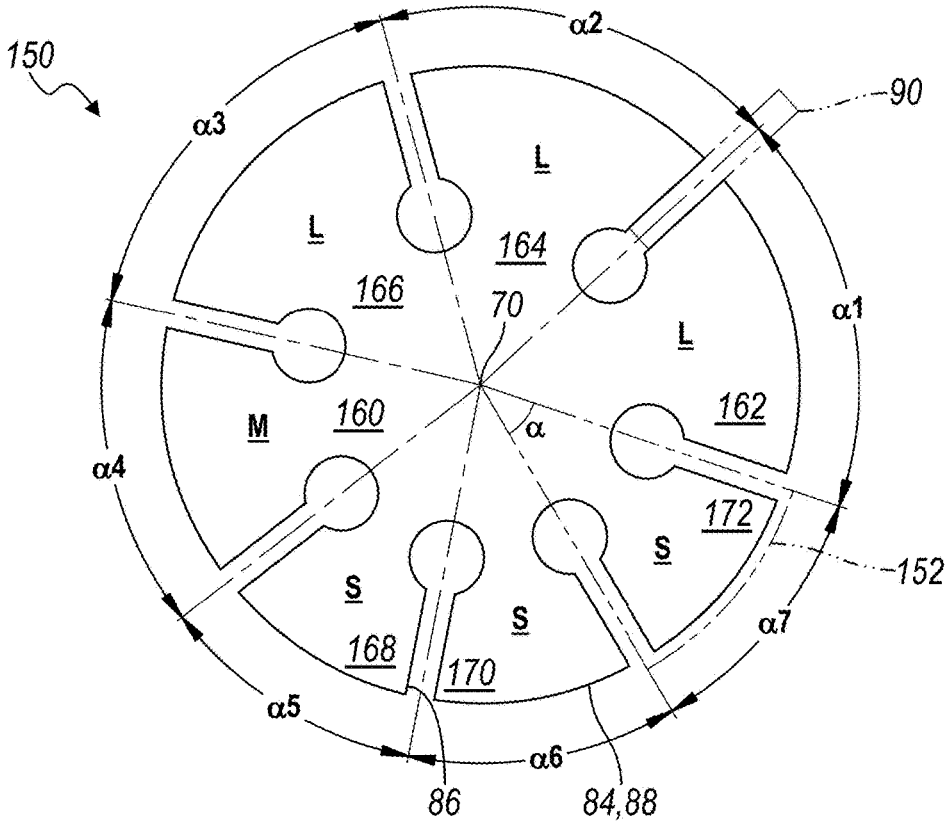
FIG. 5 illustrates an inner rotor for an oil pump with seven vanes according to an embodiment.

FIG. 5 illustrates an inner rotor 150 for use with the pump 50, for example, as rotor 80. Features of the inner rotor 150 that are the same or similar to those shown in FIG. 2 are given the same reference number.

The inner rotor 150 is provided with (n) vanes 90, where n is an odd number and is equal to seven. The slots and associated vanes for the inner rotor are spaced to provide the lowest magnitude of the most objectionable harmonics (i.e. 21, 28, 35 and 42), while meeting operational requirements for the pump.

The inner rotor has a body defining a series of slots, where there are seven slots in the described example. The slots are spaced about a perimeter of the body and extend radially outward from a central region of the body. Adjacent slots in the series of slots in the body define a series of sectors.

A series of vanes 90 is provided with each vane positioned within or received by a respective slot in the series of slots 86. The vanes 90 therefore extend radially outwardly to contact the continuous inner wall 102 of the cam ring 100, as described above with respect to FIG. 2. The vanes 90 may be slidably received within the slots 86.

The spacing and positioning of the series of slots 86 on the inner rotor 150 provides for the spacing and separation of the vanes 90, and the associated sizing of the segmented pumping chambers 120 when the inner rotor 150 is positioned within the cam ring 100.

The slots 86 or vanes 90 define a series of sectors 152 for the inner rotor. The sectors 152 meet in a central region of the inner rotor, for example, at the rotational or longitudinal axis 70 of the inner rotor. Each sector 152 is defined by a region or a slice of the inner rotor 150, and may be made up of two radials and an outer wall section, with the radials separated by a sector angle $\alpha$. The term sector is not limited to a sector of an inner rotor having an outer cylindrical wall, and the term sector may also be associated with inner rotors of various cross sectional shapes, including polygons, polygons with nonlinear outer wall segments, and the like. Each of the sectors 152 and pumping chambers 120 therefore has an associated sector angle $\alpha$ that is measured between the centerlines or radials of adjacent slots 86 or between the centerlines of adjacent vanes 90. The sector angle $\alpha$ may also be referred to as the width between or spacing of the vanes or slots.

A nominal value for the angle of the sectors of the inner rotor 150 is defined to be equal to 360 degrees divided by the number of vanes. The inner rotor of FIG. 5 has a nominal value of approximately 51.4 based on the rotor 150 having seven vanes.

The inner rotor 150 has a first sector 160 or associated chamber with a first sector angle. The first sector angle is within a first predetermined range of the nominal value such that the first sector may be referred to as a "medium" sector. The inner rotor 150 has a group of the sectors 152, shown as sectors 162, 164, 166, or associated chambers each having a sector angle that is greater than the first sector angle, the sectors 162, 164, 166 in the group of sectors may be referred to as "large" sectors. The inner rotor 150 has the remaining group of the sectors, shown as sectors 168, 170, 172, or associated chambers with a sector angle that is less than the first sector angle, with the sectors 168, 170, 172 in the remaining group of sectors being referred to as "small" sectors.

The sector angle of each of the large sectors 162, 164, 166 or the group of sectors is greater than the nominal value by a second predetermined range, and the sector angle of each s of the small sectors 168, 170, 172 or remaining group of sectors is less than the nominal value by the second predetermined range.

For the inner rotor of FIG. 5 with seven vanes, the spacing pattern is provided by three large sectors 162, 164, 166 grouped together or positioned to be consecutive, one medium sector 160, and three small sectors 168, 170, 172 also grouped together or positioned to be consecutive. As stated above, the nominal value is 360/7 or approximately 51.4 degrees. The sum of all of the sectors 152 is equal to 360 degrees.

The first predetermined range is±1.3 degrees from the nominal value, or from 50.1 to 52.7 degrees. The second predetermined range is 5±1.5 degrees from the nominal value, or 3.5 to 6.5 degrees, such that the average of the sector angle size of the three large sectors 162, 164, 166 is larger than the nominal value by 3.5 to 6.5 degrees, or from 54.9 to 57.9 degrees. The average of the sector angle size of the three small sectors is smaller than the nominal value by the second predetermined range of 5±1.5 degrees, or 3.5 to 6.5 degrees smaller, or from 44.9 to 47.9 degrees. The upper value of the first range, 1.3 degrees, is less than the lower value of the second range, 3.5 degrees.

The above description for the inner rotor 150 of a seven vane oil pump results in a minimized level of oil pump whine noise without introducing additional parts, weight, or complexity compared to a conventional pump. Table 1 below illustrates two configurations of sector angles sizing for an inner rotor of a seven vane pump according to the present disclosure, with the sectors listed in consecutive or sequential order about the inner rotor. Modeling results for noise vibration and harshness (NVH) provided a noise reduction for configurations 1 and 2 of more than 15 dB for the 21$^{st}$ order harmonic compared to a conventional seven vane pump with evenly spaced vanes,. Of course, inner rotors having other sector spacing based on the above described spacing pattern are also contemplated.

TABLE 1

Seven Vane Inner Rotor

| | Configuration 1: | | Configuration 2: | |
|---|---|---|---|---|
| Sector | Sector Angle (degrees) | Sector Size | Sector Angle (degrees) | Sector Size |
| 1 | 56.1 | L | 56.4 | L |
| 2 | 55.5 | L | 56.4 | L |
| 3 | 56.9 | L | 56.4 | L |
| 4 | 52.4 | M | 51.6 | M |
| 5 | 46.3 | S | 46.4 | S |
| 6 | 45.4 | S | 46.4 | S |
| 7 | 47.4 | S | 46.4 | S |

Therefore, the inner rotor 150 may be generalized as having an outer perimeter defining (n) axial slots 86 separating (n) sectors 152, where (n) vanes 90 are received by the (n) slots, respectively. One sector 160 has an angle within a first predetermined range of the nominal value, such that it is approximately at the nominal value. The group of (n−1)/2 sectors 162, 164, 166 have corresponding angles greater than the nominal value by a second predetermined range, and the remaining group of (n−1)/2 sectors 168, 170, 172 have corresponding angles less than the nominal angle by the second predetermined range to disrupt harmonics of the pump. The nominal value is equal to 360/n degrees. The sum of the angle of the one sector, the angles of the first group of (n−1)/2 sectors, and the angles of the remaining group (n−1)/2 sectors is 360 degrees, such that the total sum of all of the sectors is 360 degrees.

For the example shown in FIG. 5, the angle of the one sector 160 is within a first predetermined range of−1.3 to 1.3 degrees of the nominal value such that it is within 1.3 degrees of the nominal value, and the second predetermined range is 3.5 to 6.5 degrees. As can be seen in the Figure, sectors 162, 164, 166 are consecutive or are directly adjacent to one another, such that these (n−1)/2 sectors are consecutive. Sectors 168, 170, 172 are also consecutive or are directly adjacent to one another, such that these remaining (n−1)/2 sectors are also consecutive. Sector 160 is positioned between the grouping of sectors 162, 164, 166 and sectors 168, 170, 172, such that the one sector is positioned between the another (n−1)/2 sectors and the remaining (n−1)/2 sectors.

Figure 6:
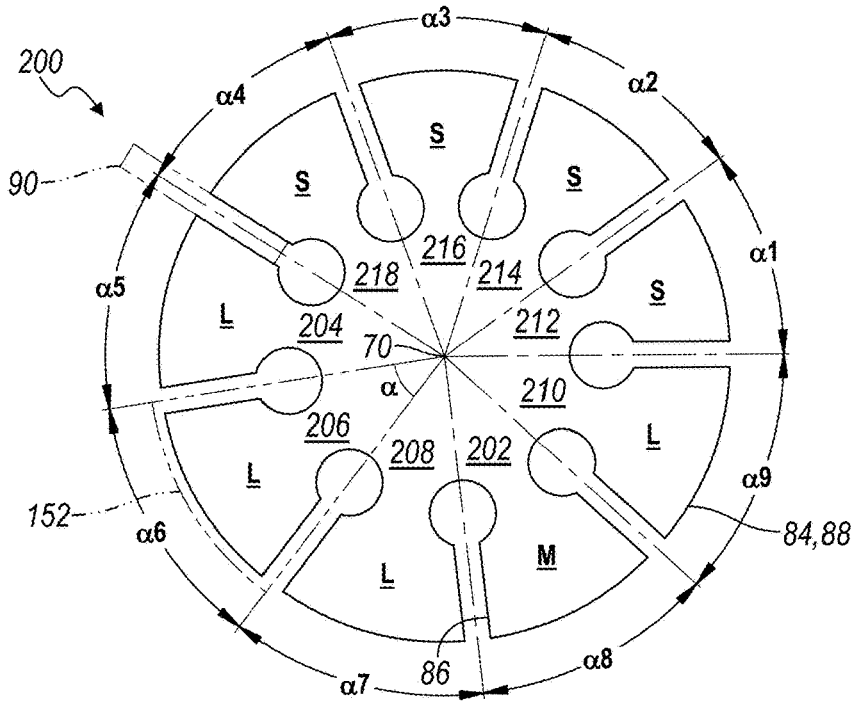
FIG. 6 illustrates an inner rotor for an oil pump with nine vanes according to an embodiment.
Figure 7:
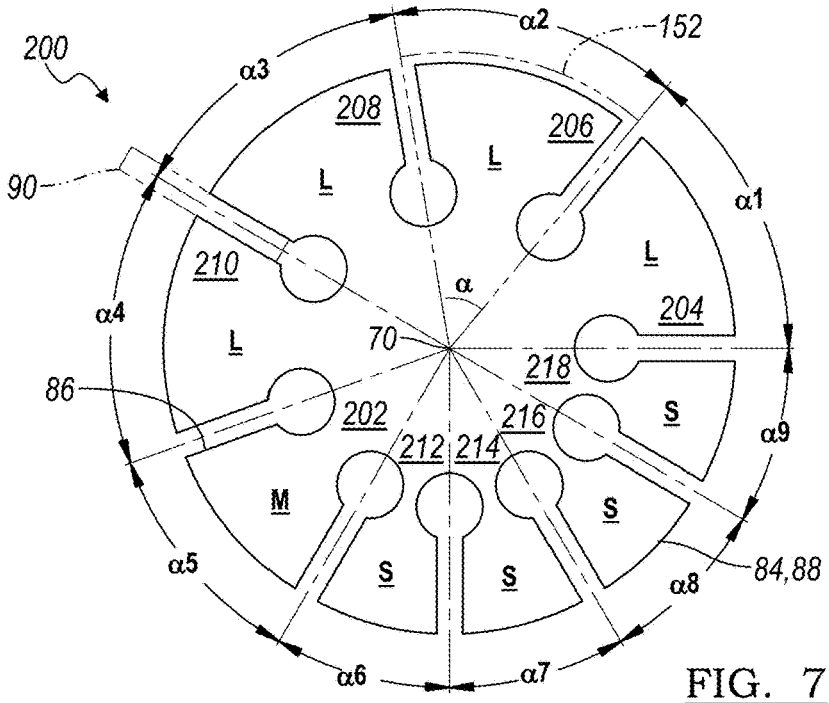
FIG. 7 illustrates another inner rotor for an oil pump with nine vanes according to an embodiment.

FIGS. 6-7 illustrate schematic views of inner rotors 200 for use with the pump 50, for example as inner rotor 80. Features of the inner rotor 200 in FIGS. 6-7 that are the same or similar to those shown and described in FIGS. 2 and 5 are given the same reference number. Each inner rotor 200 is provided with (n) vanes 90, where n is an odd number and is equal to nine. The inner rotor 200 has a body defining a series of slots 86, where there are nine slots in the described example. The slots 86 are spaced about a perimeter of the body and extend radially outward from a central region of the body or from the rotational axis 70. Adjacent slots in the series of slots 86 in the body define a series of sectors 152. The slots 86 and associated vanes 90 for the inner rotor 200 are spaced to provide the lowest magnitude of the most objectionable harmonics (i.e. 27, 36, 45 and 54) by spreading the excitation energy over a wider frequency band, while meeting operational requirements for the pump.

A series of vanes 90 is provided with each vane positioned within or received by a respective slot in the series of slots 86, where the spacing and positioning of the series of slots on the inner rotor 200 provides for the spacing and separation of the vanes 90 and the associated sizing of the segmented pumping chambers 120 of the inner rotor 200 in the cam ring.

Each inner rotor 200 has a series of sectors 152 as described above with respect to FIG. 5. The inner rotor 200 has a nominal value for the sector angle α that is equal to 360 degrees divided by the number of vanes 90. The inner rotor 200 of FIGS. 6-7 has a nominal value of 40 degrees based on the rotor having nine vanes.

The inner rotor 200 has a first sector 202 or associated chamber with a first sector angle. The first sector angle is within a first predetermined range of the nominal value such that the first sector 202 may be referred to as a "medium" sector. The inner rotor 200 has a portion of the sectors or associated chambers with a sector angle that is greater than the first sector angle, the sectors 204, 206, 208, 210 in the portion of sectors may be referred to as "large" sectors. The inner rotor 200 has the remaining portion of the sectors or associated chambers with a sector angle that is less than the first sector angle, with the sectors 212, 214, 216, 218 in the remaining portion of sectors being referred to as "small" sectors.

The sector angle of each of the large sectors 204-210 or the portion of sectors is greater than the nominal value by a second predetermined range, and the sector angle of each of the small sectors 212-218 or remaining portion of sectors is less than the nominal value by the second predetermined range.

For the inner rotor 200 of FIGS. 6-7 with nine vanes, the spacing pattern is provided by four large sectors 204-210 grouped together, one medium sector 202, and four small sectors 212-218 also grouped together. The medium sector 202 may be positioned between the two groupings of sectors as shown in FIG. 6, or may be positioned within a grouping as shown in FIG. 7. As stated above, the nominal value is 360/9 or 40 degrees. The sum of all of the sectors is equal to 360 degrees.

The first predetermined range is±1.3 degrees, or−1.3 to 1.3 degrees, from the nominal value such that the angle of the sector 202 is from 38.7 to 41.3 degrees. The second predetermined range is 3±1.5 degrees, or 1.5 to 4.5 degrees, such that the average of the sector angle size of the four large sectors 204-210 is larger than the nominal value by 1.5 to 4.5 degrees, or between 41.5 to 44.5 degrees. The average of the sector angle size of the four small sectors 212-218 is smaller than the nominal value by the second predetermined range of 3±1.5 degrees, or 1.5 to 4.5 degrees smaller, or between 35.5-38.5 degrees. The upper value of the first range, 1.3 degrees, is less than the lower value of the second range, 1.5 degrees.

The above description for the inner rotor 200 of a nine vane oil pump results in a minimized level of oil pump whine noise without introducing additional parts, weight, or complexity compared to a conventional pump. Table 2 below illustrates two configurations of sector angle sizing and positioning for an inner rotor 200 of a nine vane pump according to the present disclosure, with the sectors listed in consecutive and sequential order about the inner rotor. Modeling results for noise vibration and harshness (NVH) provided a noise reduction for configurations 3 and 4 of approximately 15 dB for the $27^{th}$ order harmonic compared to a nine vane pump with evenly spaced vanes. Of course, inner rotors having other sector spacing based on the above described spacing parameters are also contemplated.

TABLE 2

| Nine Vane Inner Rotor | | | | |
|---|---|---|---|---|
| | Configuration 3: | | Configuration 4: | |
| Sector | Sector Angle (degrees) | Size | Sector Angle (degrees) | Size |
| 1 | 43 | L | 36.4 | S |
| 2 | 43 | L | 35.8 | S |
| 3 | 43 | L | 38.4 | S |
| 4 | 43 | L | 37 | S |
| 5 | 40 | M | 41.5 | L |
| 6 | 37 | S | 44.1 | L |
| 7 | 37 | S | 42.9 | L |
| 8 | 37 | S | 41.3 | M |
| 9 | 37 | S | 42.6 | L |

Therefore, for the inner rotor 200 where n=9, the rotor has (n) axial slots 86 separating (n) sectors 152, where (n) vanes 90 are received by the (n) slots, respectively. One sector 202 has an angle within a first determined range of the nominal value, such that it is approximately at the nominal value. The group of (n−1)/2 sectors 204-210 have corresponding angles greater than the nominal value by a second predetermined range, and the group of remaining (n−1)/2 sectors 212-218 have corresponding angles less than the nominal angle by the second predetermined range to disrupt harmonics of the pump. The nominal value is equal to 360/n degrees. The sum of the angle of the one sector, the angles of the first grouping of (n−1)/2 sectors, and the angles of the remaining (n−1)/2 is 360 degrees, such that the total sum of all of the sectors is 360 degrees.

For the example shown in FIGS. 6-7, the angle of the one sector is within a first predetermined range of−1.3 to 1.3 degrees of the nominal value, or within 1.3 degrees of the nominal value, and the second predetermined range is 1.5 to 4.5 degrees. As can be seen in the Figure, sectors 204-210 are generally opposed to sectors 212-218 such that the another (n−1)/2 sectors are generally opposed to the remaining (n−1)/2 sectors. are consecutive. Sector 202 is positioned between the grouping of sectors 204-210 and sectors 212-218, or may be positioned among one of the groupings.

Figure 8:
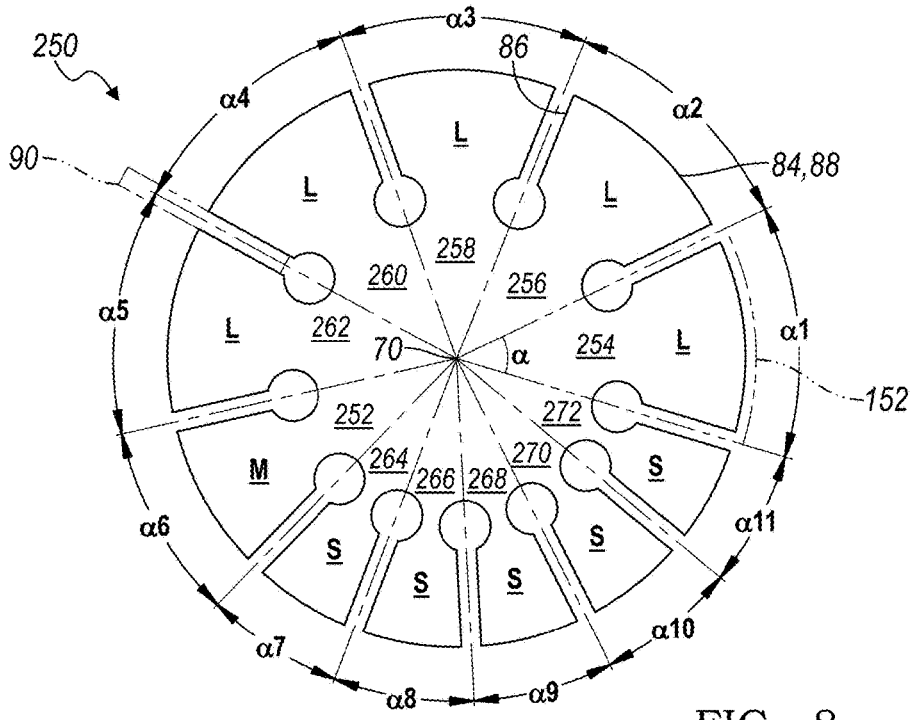
FIG. 8 illustrates an inner rotor for an oil pump with eleven vanes according to an embodiment.
Figure 9:
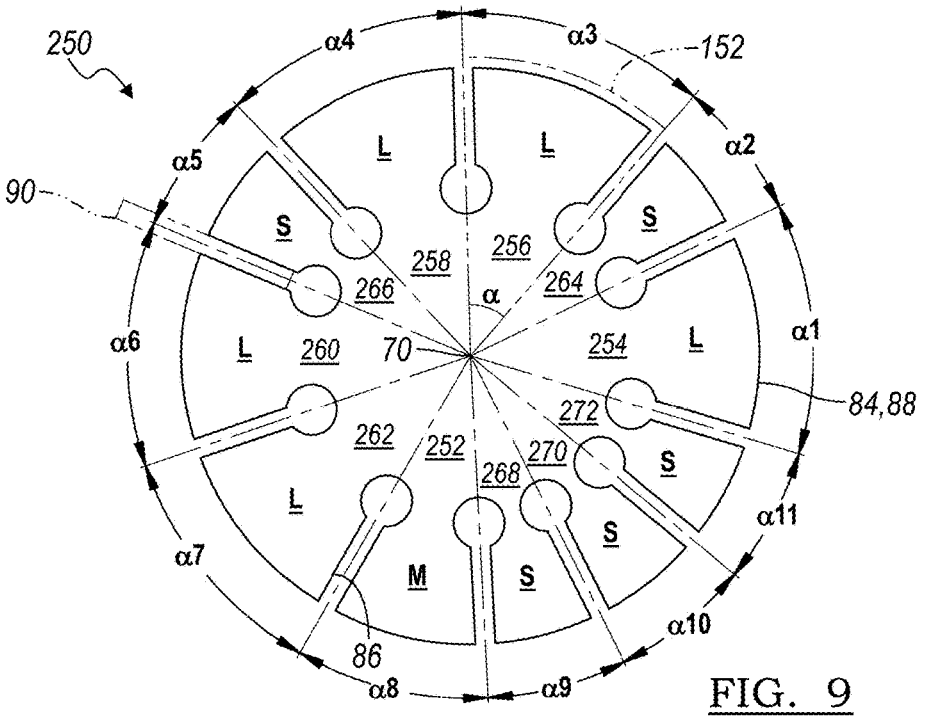
FIG. 9 illustrates another inner rotor for an oil pump with eleven vanes according to an embodiment.

FIGS. 8-9 illustrates schematic views of inner rotors 250 for use with the pump 50, for example, as rotor 80. Features in FIGS. 8-9 that are the same or similar to features in FIGS. 2 and 5 are given the same reference number. Each inner rotor 250 is provided with (n) vanes 90, where n is an odd number and is equal to eleven.

The inner rotor 200 has a body defining a series of slots 86, where there are eleven slots in the described example. The slots 86 are spaced about a perimeter of the body and extend radially outward from a central region of the body or from the rotational axis 70. Adjacent slots 86 in the series of slots in the body define a series of sectors 152. The slots 86 and associated vanes 90 for the inner rotor are spaced to provide the lowest magnitude of the most objectionable harmonics (i.e. 33, 44, 55 and 66) by spreading the excitation energy over a wider frequency band, while meeting operational requirements for the pump.

A series of vanes 90 is provided with each vane positioned within or received by a respective slot in the series of slots 86, where the spacing and positioning of the series of slots on the inner rotor 250 provides for the spacing and separation of the vanes 90 and the associated sizing of the segmented pumping chambers 120 of the inner rotor in the cam ring.

Each inner rotor 250 has a series of sectors 152 as described above with respect to FIG. 5. The inner rotor 250 has a nominal value for the sector angle $\alpha$ that is equal to 360 degrees divided by the number of vanes 90. The inner rotor 250 of FIGS. 8-9 has a nominal value of approximately 32.7 degrees based on the rotor having eleven vanes.

The inner rotor 250 has a first sector 252 or associated chamber with a first sector angle. The first sector angle is within a first predetermined range of the nominal value such that the first sector 252 may be referred to as a "medium" sector. The inner rotor 250 has a portion of the sectors or associated chambers with a sector angle that is greater than the first sector angle, the sectors 254, 256, 258, 260, 262 in the portion of sectors may be referred to as "large" sectors. The inner rotor 250 has the remaining portion of the sectors or associated chambers with a sector angle that is less than the first sector angle, with the sectors 264, 266, 268, 270, 272 in the remaining portion of sectors being referred to as "small" sectors.

An average of the sector angles of the large sectors or the portion of sectors 254-262 is greater than the nominal value by a second predetermined range, and an average of the sector angles of the small sectors or remaining portion of sectors 264-272 is less than the nominal value by the second predetermined range.

For the inner rotor 250 of FIGS. 8-9 with eleven vanes, the spacing pattern is provided by five large sectors 254-262, one medium sector 252, and five small sectors 264-272. The small, medium, and large sectors may be arranged in various orders such that they may be intermingled with one another. As stated above, the nominal value is 360/11 or 32.7 degrees. The sum of all of the sector angles for the inner rotor 250 is equal to 360 degrees.

The first predetermined range is within±0.9 degrees of the nominal value, such that the sector angle of the medium sector is between 31.8 to 33.6 degrees. The second predetermined range is 2 (+1.5/−1.0) degrees, or 1.0 to 3.5 degrees, such that the sector angle size of the five large vanes is larger than the nominal value by 1.0 to 3.5 degrees, or is from 33.7 to 36.2 degrees. The sector angle size of the five small vanes is smaller than the nominal value by the second predetermined range of 2 (+1.5/−1.0) degrees, or 1.0 to 3.5 degrees smaller, or is from 29.2 to 31.7 degrees. The upper value of the first range, 0.9 degrees, is less than the lower value of the second range, 1.0 degrees.

The above description for the inner rotor 250 of an eleven vane oil pump results in a minimized level of oil pump whine noise without introducing additional parts, weight, or complexity compared to a conventional pump. Table 3 below illustrates two configurations of sector angle sizing and positioning for an inner rotor of an eleven vane pump according to the present disclosure, with the sectors listed in consecutive and sequential order about the inner rotor. Modeling results for noise vibration and harshness (NVH) provided a noise reduction for configurations 5 and 6 of over 15 dB for the 33$^{rd}$ order harmonic compared to a conventional eleven vane pump with evenly spaced vanes. Of course, inner rotors having other sector spacing based on the above described spacing parameters are also contemplated.

TABLE 3

Eleven Vane Inner Rotor

| | Configuration 5: | | Configuration 6: | |
|---|---|---|---|---|
| Sector | Sector Angle (degrees) | Size | Sector Angle (degrees) | Size |
| 1 | 34.7 | L | 35.2 | L |
| 2 | 34.7 | L | 30.7 | S |
| 3 | 34.7 | L | 34.1 | L |
| 4 | 34.7 | L | 35 | L |
| 5 | 34.7 | L | 31.3 | S |
| 6 | 33 | M | 36.1 | L |
| 7 | 30.7 | S | 34.7 | L |
| 8 | 30.7 | S | 33.4 | M |
| 9 | 30.7 | S | 30 | S |
| 10 | 30.7 | S | 30 | S |
| 11 | 30.7 | S | 29.7 | S |

Therefore, for the inner rotor 250 where n=11, the rotor has (n) axial slots 86 separating (n) sectors 152, where (n) vanes 90 are received by the (n) slots, respectively. One sector 252 has an angle within a first range of the nominal value, such that the one sector 252 is approximately at the nominal value. The (n−1)/2 sectors 254-262 have corresponding angles greater than the nominal value by a second predetermined range, and the remaining (n−1)/2 sectors 264-272 have corresponding angles less than the nominal angle by the second predetermined range to disrupt harmonics of the pump. The nominal value is equal to 360/n degrees. The sum of the angle of the one sector, the angles of the first grouping of (n−1)/2 sectors, and the angles of the remaining (n−1)/2 is 360 degrees, such that the total sum of all of the sectors is 360 degrees.

For the example shown in FIGS. 8-9, the angle of the one sector is within a first predetermined range of−0.9 to 0.9 degrees of the nominal value or within 0.9 degrees of the nominal value, and the second predetermined range is 1.0 to 3.5 degrees.

As can be seen in each of FIGS. 5-9, the pump has an inner rotor with an odd number or unevenly spaced vanes. The nominal value for vane spacing is 360 degrees divided by a number of vanes in the series of vanes. A lower value in the second predetermined range is greater than an upper value in the first predetermined range such that the size of the sector angles in the different groups of sectors does not overlap.

One sector of the series of sectors has an angle within a first predetermined angular range. A first portion of sectors in the series of sectors have corresponding angles within a second predetermined angular range. A second remaining portion of sectors in the series of sectors have corresponding angles within a third predetermined angular range, the first angular range being between and non-overlapping with the second and third angular ranges. The first predetermined angular range contains a nominal value equal to 360 degrees divided by a number of vanes in the series of vanes. A sum of the angles of the one sector, the first portion of sectors, and the second portion of sectors is 360 degrees. The first and second portions of sectors each contain an equivalent number of sectors. With reference to the rotor described with respect to FIG. 8-9 as a non-limiting example, the first predetermined range is 31.8 to 33.6 degrees, the second predetermined range is 33.7 to 36.2 degrees, and the third predetermined range is 29.2 to 31.7 degrees.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A vane fluid pump for a vehicle component comprising:

a cam ring defining a continuous inner wall surrounding a cavity;

an inner rotor supported within the cam ring, the inner rotor having an outer wall defining a series of slots spaced about the outer wall;

a drive shaft coupled for rotation with the inner rotor; and a series of vanes, each vane positioned within a respective slot of the inner rotor and extending radially outwardly to contact the continuous inner wall of the cam ring, the series of vanes defining and separating a series of non-uniformly sized segmented pumping chambers configured to disrupt harmonics during operation to reduce pressure ripples and associated tonal noise, one chamber of the series of chambers having a first sector angle being within a first predetermined range of a nominal value, each chamber in a first group of chambers of the series of chambers having a sector angle greater than the nominal value by a second predetermined range, and each chamber in a second remaining group of chambers of the series of chambers having a sector angle less than the nominal value by the second predetermined range;

wherein the nominal value is 360 degrees divided by a number of vanes in the series of vanes;

wherein the lowest sector angle in the first group of chambers is greater than an upper value of the first predetermined range; and wherein the highest sector angle in the second group of chambers is lower than a lower value of the first predetermined range.

2. The pump of claim 1 wherein the continuous inner wall of the cam ring is cylindrical; and wherein the inner rotor is eccentrically supported within the cam ring.

3. The pump of claim 2 wherein the outer wall of the inner rotor is cylindrical.

4. The pump of claim 1 wherein each vane is slidably received by the respective slot of the inner rotor.

5. The pump of claim 1 further comprising a vane ring positioned on an end face of the inner rotor;

wherein an inner end of each vane abuts the vane ring such that the vane ring is configured to prevent retraction of the vanes in the slots.

6. The pump of claim 1, wherein the cam ring is movable such that the pump is a variable displacement pump; and wherein a total number of vanes in the series of vanes is odd.

7. An inner rotor for a vane fluid pump comprising:

a body having a series of slots spaced about a perimeter of the body and extending radially outward, adjacent slots in the series of slots in the body defining a series of sectors; and a series of vanes, each vane slidably received within a respective slot;

wherein one sector of the series of sectors has an angle within a first predetermined angular range, wherein a first group of sectors in the series of sectors have corresponding angles within a second predetermined angular range, and wherein a second group of sectors in the series of sectors have corresponding angles within a third predetermined angular range, the first angular range being between and non-overlapping with the second and third angular ranges;

wherein the first predetermined angular range contains a nominal value equal to 360 degrees divided by a number of vanes in the series of vanes;

wherein a sum of the angles of the one sector and the first and second group of sectors is 360 degrees; and wherein the first group of sectors and the second group of sectors each contain an equivalent number of sectors.

8. A pump comprising:

an inner rotor driven by a shaft, eccentrically supported within a cam in a housing, and having an outer perimeter defining (n) axial slots separating (n) sectors, one sector having an angle approximately at a nominal value of 360/n, another (n−1)/2 sectors having corresponding angles greater than the nominal value, and the remaining (n−1)/2 sectors having corresponding angles less than the nominal value; and (n) vanes received by the (n) slots, respectively.

9. The vane pump of claim 8 wherein a sum of the angle of the one sector, the angles of the another (n−1)/2 sectors, and the angles of the remaining (n−1)/2 sectors is 360 degrees.

10. The vane pump of claim 8 wherein each angle of the another (n−1)/2 sectors is greater than the angle of the one sector; and wherein each angle of the remaining (n−1)/2 sectors is less than the angle of the one sector.

11. The vane pump of claim 8 wherein the angle of the one sector is within a first predetermined range of the nominal value.

12. The vane pump of claim 11 wherein each angle of the (n−1)/2 sectors is greater than the nominal value by a second predetermined range; and wherein each angle of the (n−1)/2 sectors is less than the nominal value by the second predetermined range.

13. The vane pump of claim 12 wherein (n) is seven; and wherein the first predetermined range is −1.3 to 1.3 degrees; and wherein the second predetermined range is 3.5 to 6.5 degrees.

14. The vane pump of claim 13 wherein the another (n−1)/2 sectors are consecutive;

wherein the remaining (n−1)/2 sectors are consecutive; and wherein the one sector is positioned between the another (n−1)/2 sectors and the remaining (n−1)/2 sectors.

15. The vane pump of claim 12 wherein (n) is nine; and wherein the first predetermined range is −1.3 to 1.3 degrees; and wherein the second predetermined range is 1.5 to 4.5 degrees.

16. The vane pump of claim 15 wherein the another (n−1)/2 sectors are generally opposed to the remaining (n−1)/2 sectors.

17. The vane pump of claim 12 wherein (n) is eleven; and wherein the first predetermined range is −0.9 to 0.9 degrees; and wherein the second predetermined range is 1.0 to 3.5 degrees.

* * * * *